US007982448B1

(12) United States Patent
Prasad et al.

(10) Patent No.: US 7,982,448 B1
(45) Date of Patent: Jul. 19, 2011

(54) CIRCUIT AND METHOD FOR REDUCING OVERSHOOTS IN ADAPTIVELY BIASED VOLTAGE REGULATORS

(75) Inventors: Soundararajan Srinivasa Prasad, Bangalore (IN); Damaraju Naga Radha Krishna, La Jolla, CA (US)

(73) Assignee: Cypress Semiconductor Corporation, San Jose, CA (US)

( * ) Notice: Subject to any disclaimer, the term of this patent is extended or adjusted under 35 U.S.C. 154(b) by 603 days.

(21) Appl. No.: 11/961,190

(22) Filed: Dec. 20, 2007

Related U.S. Application Data

(60) Provisional application No. 60/876,806, filed on Dec. 22, 2006.

(51) Int. Cl.
*G05F 3/16* (2006.01)

(52) U.S. Cl. ..... 323/315; 323/311; 323/312

(58) Field of Classification Search ..... 363/315, 363/311, 312, 314, 316, 317; 327/538, 540; 323/311, 312, 313, 314, 316, 317, 269, 270, 323/273

See application file for complete search history.

(56) References Cited

U.S. PATENT DOCUMENTS

| | | | | |
|---|---|---|---|---|
| 6,081,108 | A * | 6/2000 | Marshall | 323/315 |
| 6,348,835 | B1 * | 2/2002 | Sato et al. | 327/543 |
| 6,617,832 | B1 * | 9/2003 | Kobayashi | 323/266 |
| 6,847,254 | B2 * | 1/2005 | Pai | 327/572 |
| 7,332,957 | B2 * | 2/2008 | Hasegawa | 327/543 |
| 2001/0017537 | A1 * | 8/2001 | Antheunis | 323/312 |

* cited by examiner

*Primary Examiner* — Adolf Berhane
*Assistant Examiner* — Nguyen Tran

(57) ABSTRACT

Disclosed are a circuit and a method for adaptively biasing a voltage regulator with minimal output overshoot. The circuit includes an adaptive bias current mirror circuit further including a first transistor and a second transistor, the first transistor and the second transistor having source nodes coupled to a drain node of the first transistor. The circuit includes a common node coupled to the source node of the first transistor and the source node of the second transistor, wherein a source degenerate resistor is coupled to the adaptive bias current mirror circuit and is coupled to the common node and wherein the source degenerate resistor is configured to limit an output peak current of the voltage regulator circuit.

18 Claims, 7 Drawing Sheets

CIRCUIT AND METHOD FOR REDUCING OVERSHOOTS IN ADAPTIVELY BIASED VOLTAGE REGULATORS

This application claims priority under 35 U.S.C. §119(e) to U.S. Provisional Application No. 60/876,806, filed on Dec. 22, 2006, the entire contents of which are hereby incorporated by reference herein.

BACKGROUND

1. Field of the Invention

The present invention relates to voltage regulator circuits. More particularly, the present invention relates to a circuit and method for reducing overshoots in adaptively biased voltage regulators.

2. Background Information

A conventional voltage regulator, which is sometimes referred to as a linear regulator, is used to provide power to low voltage digital and analog circuits, where point-of-load and line regulation is important. Conventional linear regulators suffer from poor transient response. Transient response is the behavior of the linear regulator after an abrupt change of either the load current (load response) or the input voltage (line response). A minimum undershoot and overshoot of the regulated voltage and a fast settling time is desired in the voltage regulator circuit.

FIG. 1 illustrates a conventional multi-loop voltage regulator circuit 100 that comprises a buffer (gain) amplifier 102 to push the gate pole of the output device 101 (e.g., a PMOS pass device) to high frequencies. Transistor 103 provides adaptive biasing of the buffer amplifier 102. Further shown in FIG. 1 are the equivalent series resistance (ESR) 111 and equivalent series inductance (ESL) 112 of the load capacitor 113. In the event of low loads, the out-pole formed by the load capacitor 113 and the load resistance 110 goes to low frequencies thereby also lowering the gate-pole. The voltage regulator circuit 100 uses the buffer (gain) amplifier 102 to adjust its gain in response to a load current passing through the output device 101 such that as the load current decreases, the gain increases. Conventional solutions to meet the fast settling time require the tail current of the buffer amplifier to be boosted at the start.

FIG. 2 illustrates a conventional voltage regulator circuit 200 using a buffer amplifier as an adaptive biased drive stage. The voltage regulator circuit 200 comprises a buffer amplifier 201 coupled to an output device 202 through a resistor 220. A feedback transistor device 203 is coupled between the non-inverting node of the buffer amplifier 201 and a far terminal of the resistor 220. The far terminal of the resistor 220 is coupled to a gate terminal of the device 202. An output terminal of the device 202 is coupled to a load circuit (ESR 211, ESL 212, capacitor 213 and resistor 210). The buffer amplifier 201 pushes the gate pole of the output device 202 to high frequencies. Transistor 203 provides adaptive biasing of the buffer amplifier 201. Although adaptive biasing improves the start up time of ultra low power voltage regulators, a disadvantage of the conventional solution 200 is that intolerable overshoots are observed at the regulator output that make the given circuit scheme unsuitable for its desired applications.

Referring to FIG. 3, a conventional voltage regulator circuit 300 comprising an excess bias tail current configuration is shown. The regulator 300 comprises an amplifier 301, which is coupled to an input signal at its non inverting (+) terminal. The amplifier 301 is coupled to an enable switch 302 and a current source ($I_{tail_plus}$) 303. The current source 303 is terminated at a ground terminal. The load circuit of the voltage regulator circuit 300 comprises an R-L-C circuit (resistor 311, inductor 312 and a capacitor 313). A resistor load 310 is coupled at a common output node (Vout) of the amplifier 301. The enable switch 302 and the current source 303 switch in a pulsed current during start up of the voltage regulator circuit 300. When enabled, excess current $I_{tail_plus}$ is switched in to the tail of the amplifier 301, thereby improving the slew rate of the amplifier. Thus, the startup time of the voltage regulator circuit is reduced.

To limit overshoots in the conventional solutions (e.g., as illustrated in FIGS. 1, 2 and 3), either the adaptive biasing is slightly compromised or a pulsed tail current is switched in during start-up. Further disadvantages of conventional solutions include huge area demand for large currents, compensation at higher tail current during start up if not compensated at the load, and the need for a pulse generation for turning off the switched-in current after start-up if the regulator gets enabled with a signal (area impact). If the digital signal is not available during start-up, then design-complexity will increase (e.g., comparators may be used to sense the voltage and turn-off).

It is desirable to have an improved and reliable voltage regulator circuit that meets the circuit start up time specification, as well as maintain the output overshoots within desirable limits.

SUMMARY OF THE INVENTION

A circuit and method are disclosed for meeting start up time of a voltage regulator. Overshoots observed at the output of the voltage regulator are controlled. In accordance with exemplary embodiments of the present invention, according to a first aspect of the present invention, a voltage regulator circuit includes an adaptive bias current mirror circuit further comprising a first transistor and a second transistor; the first transistor and the second transistor having source nodes coupled to a drain of the first transistor. A common node is coupled to the source node of the first transistor and the source node of the second transistor. A source degenerate resistor is coupled to the adaptive bias current mirror circuit and coupled to the common node and is configured to limit an output peak current of the voltage regulator circuit.

According to the first aspect, the voltage regulator circuit includes a third transistor and a fourth transistor having source nodes commonly coupled to form a tail node. The voltage regulator circuit includes a bias transistor having a drain coupled to the tail node and a source coupled to a circuit ground. The voltage regulator circuit comprises a current mirror circuit further comprising a fifth transistor and a sixth transistor having common gates coupled to a gate of a seventh transistor. Drain nodes of the fifth transistor and the sixth transistor being coupled with drain nodes of the third transistor and the fourth transistor, the fifth, sixth and seventh transistors have source nodes commonly coupled to an external voltage. A drain node of the seventh transistor is commonly coupled to the drain node of the first transistor of the adaptive bias current mirror circuit. According to an exemplary embodiment of the present invention, the voltage regulator circuit comprises a source node of an output transistor coupled to an output resistive load circuit; Wherein a drain node coupled to an external voltage; a load capacitor coupled to common gate nodes of the fifth transistor, sixth transistor and the output transistor; and a gate of the fourth transistor coupled to the common output node of the load circuit.

According to an exemplary embodiment of the first aspect of the present invention, a positive input voltage differential is an input signal at a gate of the third transistor to provide a high current to the adaptive bias current mirror circuit at tail node. The high current at the adaptive bias current mirror circuit develops a voltage drop across source degenerate resistor limiting the Gate-to-Source voltage of the adaptive bias current mirror transistors and output peak current.

In an exemplary embodiment of the present invention, the voltage regulator circuit comprises an adaptive bias current mirror circuit further comprising a first transistor and a second transistor; the first transistor and the second transistor having source nodes coupled to a drain of the first transistor; a first source degenerate resistor coupled to the first transistor; and a second source degenerate resistor coupled to the second transistor, wherein the first and second source degenerate resistors are configured to limit an output peak current of the adaptive bias current mirror circuit to maintain a predetermined start-up time of the voltage regulator circuit.

According to a second aspect of the present invention, a method to reduce overshoots in adaptively biased voltage regulators includes a step of adaptively biasing a plurality of transistors to form an adaptively biased current mirror circuit; and coupling at least one source degenerate resistor to the adaptively biased current mirror circuit to limit an output peak current of the voltage regulator circuit to maintain a predetermined start-up time of the voltage regulator circuit.

According to the second aspect, the method to reduce overshoots in adaptively biased voltage regulator further comprises a step of converting a startup positive voltage difference at an input of the voltage regulator to a high current using a plurality of transistors, and feeding back the high current as a tail current to the voltage regulator, thereby increasing output voltage startup and stewing rates. The high current generated by the plurality of transistors is configured to build up current in the adaptive bias current mirror circuit and to provide a voltage drop across at least one source degenerate resistor. The method of the present invention comprises generating a voltage drop across the degenerate resistor to limit current buildup at the tail of the voltage regulator and to limit output overshoot. According to an example of the present invention, the method comprises limiting an overshoot in a node of current multiplication through at least one source degenerate resistor and connecting the source degenerate resistor to a source side of a voltage regulator circuit. The source degenerate resistor degenerates to limit a tail current to a predetermined value.

According to a third aspect of the present invention, a voltage regulation device includes a gate connected current mirror circuit. The device includes a pair of input transistors coupled to the gate connected current mirror transistor circuit; an adaptive bias current mirror circuit coupled to the pair of input transistors and a bias transistor coupled to the pair of input transistors.

According to the third aspect, the gate connected current mirror circuit comprises a pair of current mirror transistors having common gate connected to a mirror transistor and connected to an output transistor. A voltage signal is coupled to an input terminal of a first input transistor of the pair of input transistors. The adaptive bias current mirror circuit comprising a source degeneration unit. Both the adaptive bias current mirror circuit and the bias circuit are coupled to a common node of the pair of input transistors. A load capacitor is coupled between the gate connected current mirror circuit and an output transistor.

BRIEF DESCRIPTION OF THE DRAWINGS

Other objects and advantages of the present invention will become apparent to those skilled in the art upon reading the following detailed description of preferred embodiments, in conjunction with the accompanying drawings wherein like reference numerals have been used to designate like elements, and wherein.

DETAILED DESCRIPTION OF THE PREFERRED EMBODIMENTS

Figure 1:
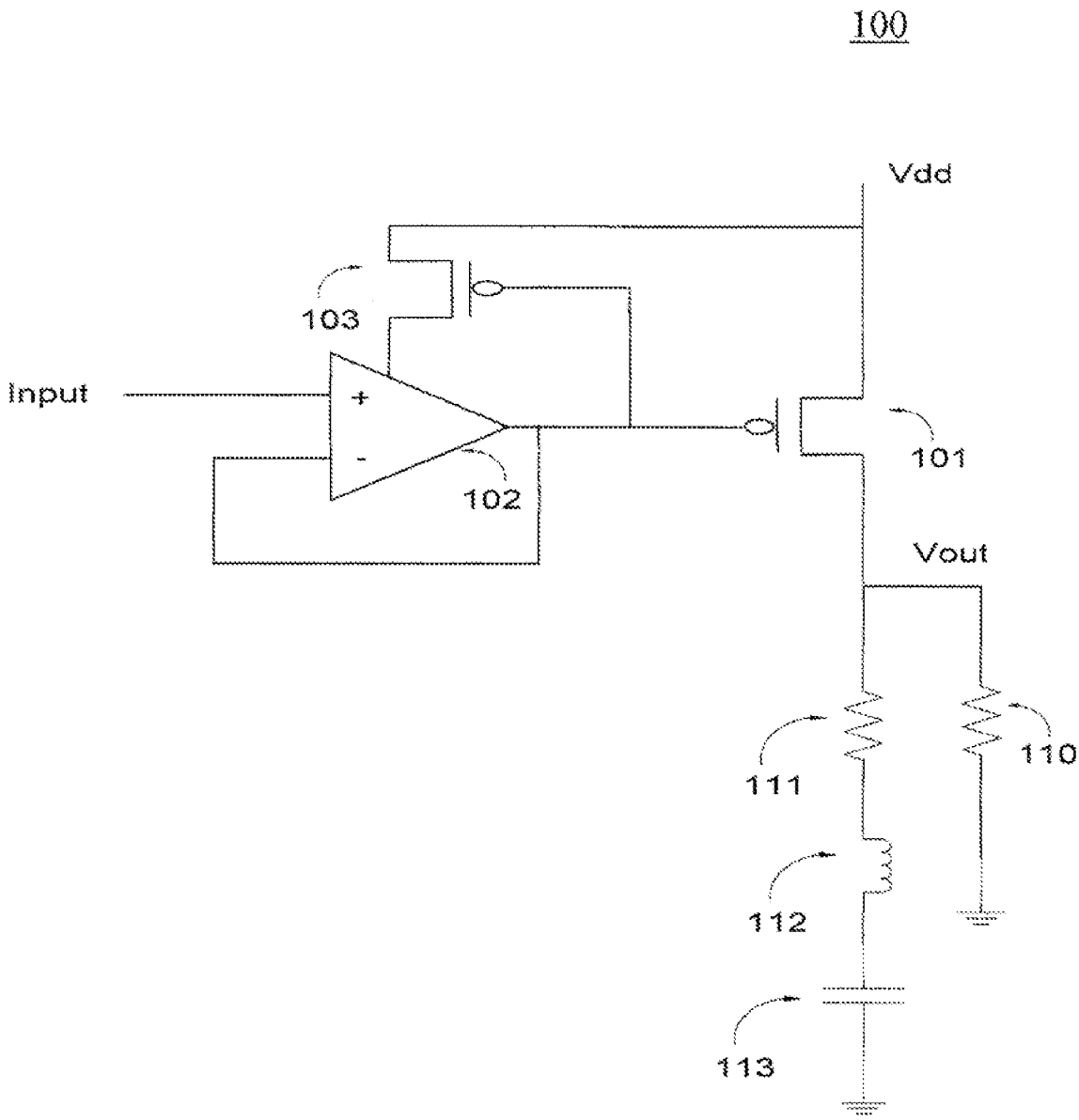
FIG. 1 (RELATED ART)
FIG. 1 illustrates a conventional voltage regulator circuit using a buffer amplifier for adaptive biasing.
Figure 2:
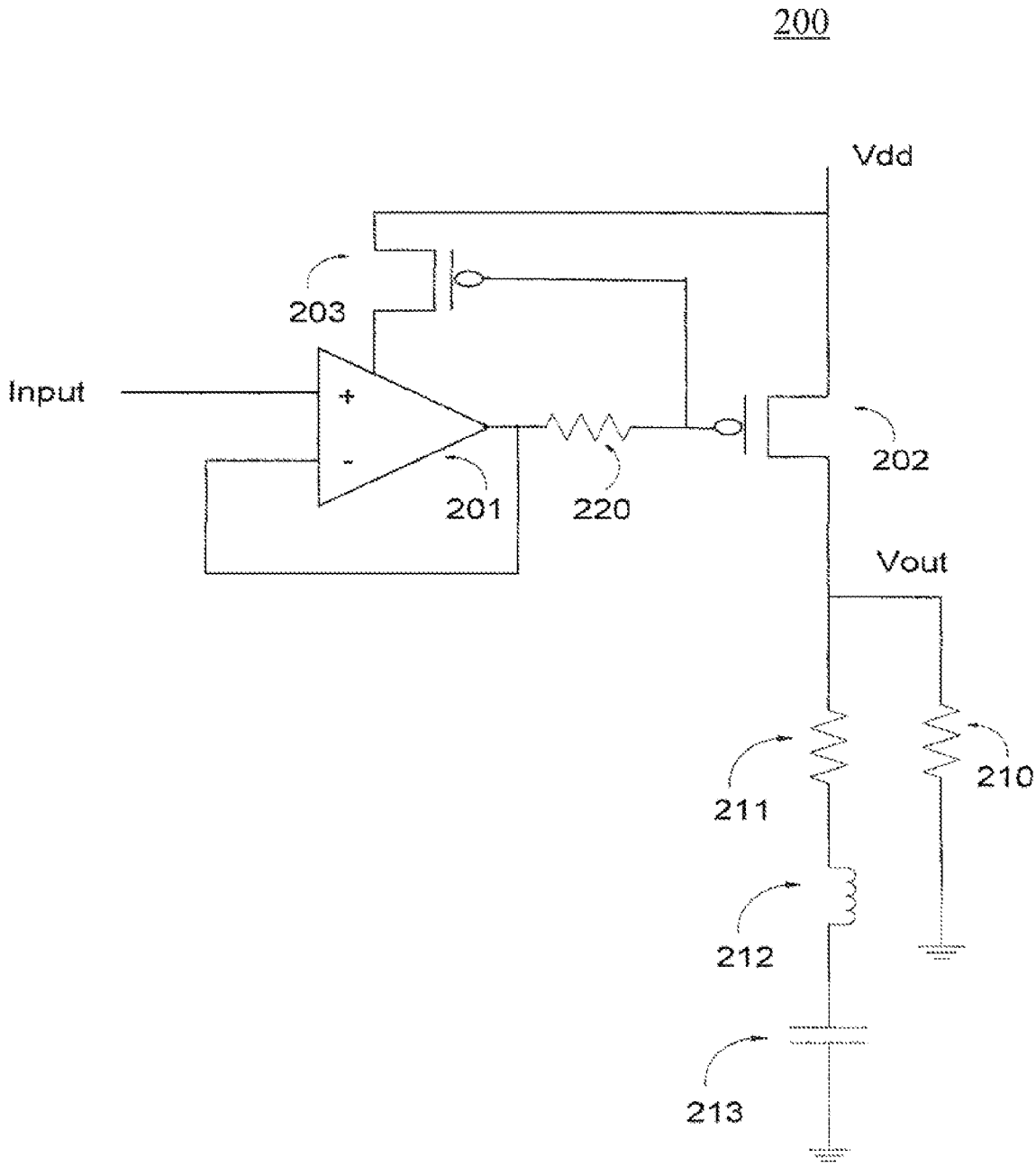
FIG. 2 (RELATED ART)
FIG. 2 illustrates a conventional voltage regulator circuit using a buffer amplifier as an adaptive biased drive stage.
Figure 3:
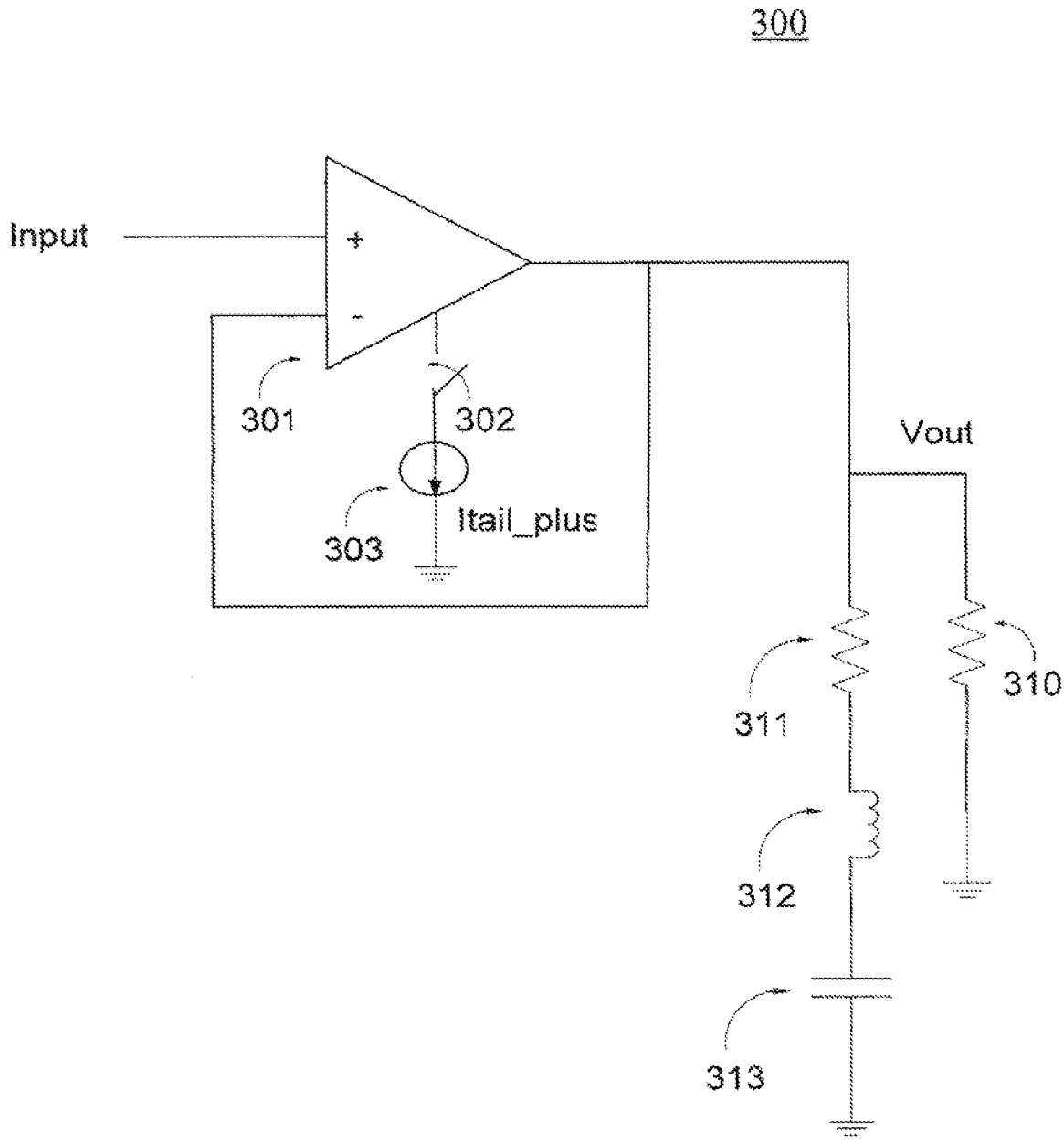
FIG. 3 (RELATED ART)
FIG. 3 illustrates a conventional voltage regulator circuit comprising an excess bias tail current configuration.

Exemplary embodiments of the present invention are directed to a circuit and method for reducing overshoots in adaptively biased voltage regulators. Source degeneration of the adaptive bias current mirrors is used as a self-corrective mechanism to limit the current when it builds very high. Thus, the overshoots at the output of the adaptively biased voltage regulator are minimized and the start up time specification of the voltage regulator is maintained. In accordance with an exemplary embodiment of the present invention, the voltage regulator circuit includes an adaptive bias current mirror circuit comprising a first transistor and a second transistor. The first transistor and the second transistor include source nodes coupled to a drain node of the first transistor. A common node is coupled to the source node of the first transistor and the source node of the second transistor. A source degenerate resistor is coupled to the adaptive bias current mirror circuit and is coupled to the common node. According to exemplary embodiments, the source degenerate resistor is configured to limit the output peak current of the adaptive bias current mirror circuit.

In an exemplary embodiment of the present invention, the adaptively biased voltage regulator circuit comprises a third transistor and a fourth transistor having source nodes commonly coupled to form a tail node. A bias transistor includes a drain node coupled to the tail node and a source coupled to a circuit ground or other reference voltage. The voltage regulator circuit comprises a current mirror circuit comprising a fifth transistor and a sixth transistor having common gates coupled to a gate of a seventh transistor. Drain nodes of the fifth transistor and the sixth transistor are coupled with drain nodes of the third transistor and the fourth transistor. The fifth, sixth and seventh transistors have source nodes commonly coupled to an external voltage. A drain node of the seventh transistor is commonly coupled to the drain node of the first transistor of the adaptive bias current mirror circuit.

According to an exemplary embodiment of the present invention, an adaptively biased voltage regulator device comprises a gate connected current mirror circuit, a pair of input transistors coupled to the gate connected current mirror transistor circuit, an adaptive bias current mirror circuit coupled to the pair of input transistors, and a bias transistor coupled to the pair of input transistors. The gate connected current mirror circuit comprises a pair of current mirror transistors having common gate connected to a mirror transistor and connected to an output transistor. A voltage signal is coupled to an input terminal of a first input transistor of the pair of input transistors. The adaptive bias current mirror circuit comprises a source degeneration unit. Both the adaptive bias current mirror circuit and the bias circuit are coupled to a common node of the pair of input transistors. A parasitic capacitor is coupled between the gate connected current mirror circuit and an output transistor. Thus, by source degeneration of the adaptive bias current mirrors, the overshoots at the output of the voltage regulator are minimized and the start up time of the voltage regulator is also maintained.

Figure 4:
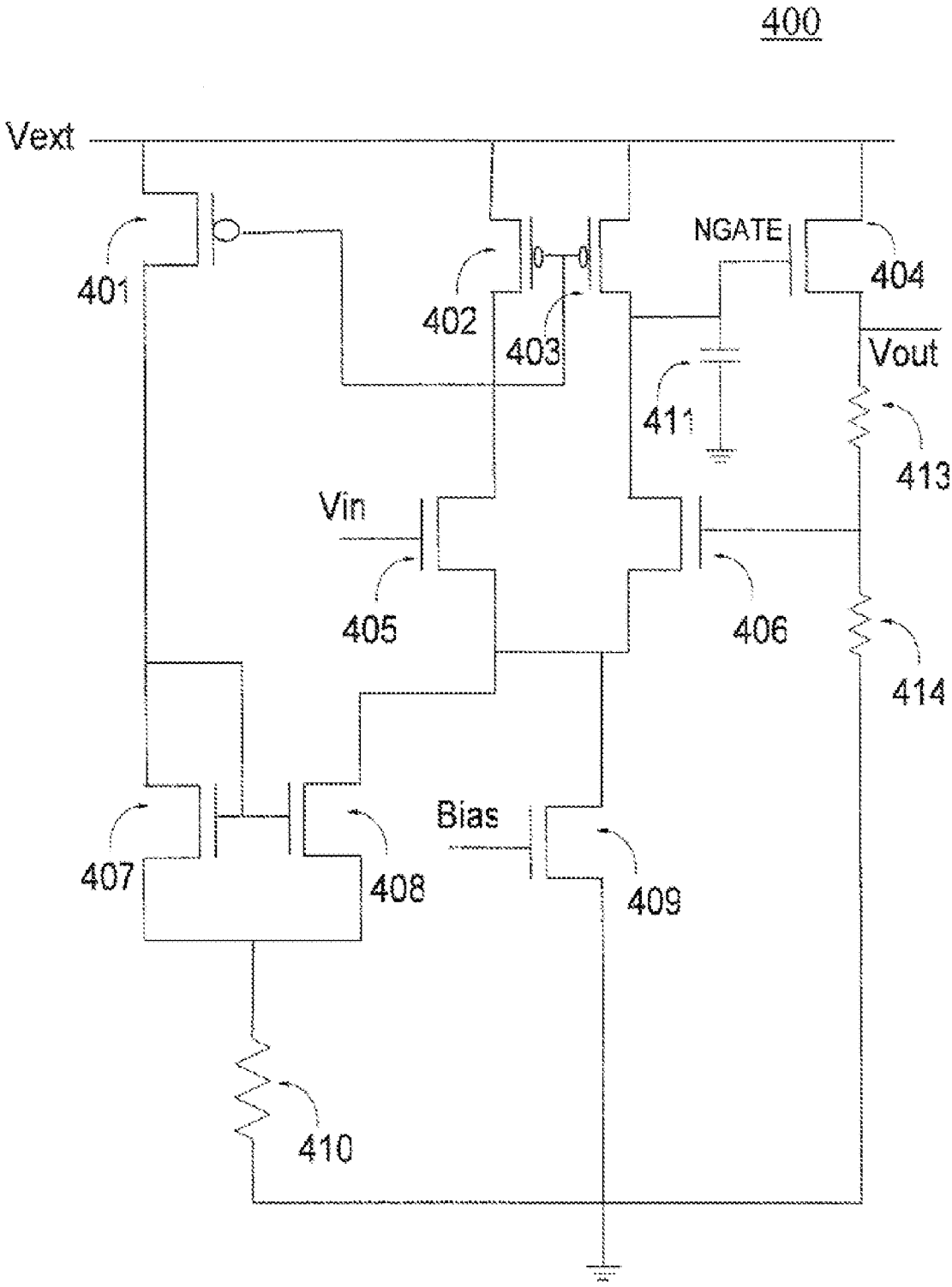
FIG. 4 illustrates a circuit for source degeneration on adaptive bias current mirrors, in accordance with an exemplary embodiment of the present invention.

These and other aspects and embodiments of the present invention will now be described in greater detail. FIG. 4 illustrates an adaptively biased voltage regulator circuit 400 generating a minimal overshoot output, in accordance with an exemplary embodiment of the present invention. The circuit 400 comprises a transistor 401, first and second adaptive biased current mirror transistors 407 and 408, respectively, and bias transistor 409. The voltage regulator 400 further comprises first and second input transistors 405 and 406, respectively. The voltage regulator circuit 400 also comprises first and second current mirror transistors 402 and 403 whose common gates are connected to the transistor 401. The voltage regulator circuit 400 further comprises load resistors 413 and 414, and a parasitic capacitance 411 coupled to an NGATE node of the output transistor. A source degenerate resistor 410 is coupled to the adaptive biased current mirror transistors 407 and 408.

According to an exemplary embodiment of the invention, the transistor 401 comprises a source terminal coupled to the voltage Vext, a drain terminal is further coupled to a drain terminal of the transistor 407 and a gate terminal is coupled to a common node of transistors 402 and 403. The transistor 402 comprises a source terminal coupled to the voltage Vext, a drain terminal is further coupled to a drain terminal of the transistor 405 and a gate terminal is further coupled to a gate terminal of the transistor 403. The transistor 403 also comprises a source terminal, which is coupled to the voltage Vext and a drain terminal, which is further coupled to a drain terminal of the transistor 406. The transistor 404 comprises a drain terminal, which is coupled to Vext. A gate terminal of the transistor 404 is coupled to the drain terminal of the transistor 403. A source terminal of the transistor 404 is coupled to an output node Vout and is coupled to a resistor 413. The transistor 405 comprises a gate terminal, which is coupled to an input voltage Vin, a drain terminal further coupled to the drain terminal of the transistor 402 and a source terminal, which is coupled to a drain terminal of the transistor 408. The parasitic capacitance 411 is coupled to a junction of the transistors 403 and 404 at a first end and is coupled to a grounded node at a second end.

In accordance with an exemplary embodiment, the transistor 406 comprises a drain terminal further coupled to the drain terminal of the transistor 403. A source terminal of the transistor 406 is further coupled to the source terminal of the transistor 405. Gate terminal of the transistor 406 is coupled to a common node of the resistor 413 and the resistor 414. The transistor 407 comprises a drain terminal coupled to its gate terminal and a source terminal of the transistor 407 is further coupled to a source terminal of the transistor 408. Gate terminals of transistors 407 and 408 are coupled and a drain terminal of the transistor 408 is coupled to a source terminal of the transistor 405. The transistor 409 comprises a drain terminal, which is coupled to a node common to the transistors 405 and 406. A gate terminal of the transistor 409 is coupled to the signal Bias and a source terminal is coupled to a grounded node. The source degenerate resistor is coupled to a node common to the transistors 407 and 408. In an exemplary and a non limiting embodiment, the source degenerate resistor can be 10 Kilo ohms. The transistors used in the adaptively biased voltage regulator circuit 400 can be P type or N type transistors in a non limiting example of the invention.

For an external voltage (Vext) applied (in one exemplary embodiment, 1.69 volts, although other suitable voltages can be used), an input reference supply voltage (Vin) is established at the gate of input transistor 405, thereby creating a positive voltage difference between transistors 405 and 406. Such a positive voltage difference is fed through first and second current mirror transistors 402 and 403 and is converted to DC current. The DC current is further amplified by both the transistor 401 and the first and second adaptive biased current mirror transistors 407 and 408 before being fed back to the tail (node comprising a junction of transistors 405, 406 and 409) of the voltage regulator 400. The tail current of the voltage regulator 400 is therefore increased by positive feedback loop created by the transistors 401, 407 and 408 thereby slewing the node NGATE faster, wherein NGATE is formed by connecting drain terminal of the transistor 403 to gate terminal of the output transistor 404. The NGATE node slews faster due to increased current crested by the positive feedback loop (transistors 401, 407 and 408). Thus, the output of the regulator follows the node NGATE, which therefore slews faster.

According to an exemplary embodiment of the present invention, a voltage regulator circuit 400 includes an adaptive bias current mirror circuit further comprising a first transistor 407 and a second transistor 408 having their source nodes and gate terminals coupled to each other in a current mirror configuration. A source degenerate resistor 410 is coupled to the adaptive bias current mirror circuit through a common node of transistors 407 and 408. The voltage regulator comprises a third transistor 405 and a fourth transistor 406 having source nodes are commonly coupled to form a tail node. The voltage regulator circuit 400 also comprises a bias transistor 409 having a drain coupled to the tail node and a source coupled to a circuit ground. A positive input voltage differential Vin comprises an input signal at a gate of the third transistor 405 to provide a high current to the adaptive bias current mirror circuit and tail node. The improved voltage regulator circuit 400 is configured to generate a voltage drop across at least one source degenerate resistor to limit a current buildup at a tail of the voltage regulator and to limit an output overshoot.

In an alternate exemplary embodiment of the present invention, the voltage regulator circuit 400 comprises a current mirror circuit comprising a fifth transistor 402 and a sixth transistor 403 having common gates further coupled to a gate of a seventh transistor 401. Drain nodes of the fifth transistor 402 and the sixth transistor 403 are coupled with drain nodes of the third transistor 405 and the fourth transistor 406, the fifth 402, sixth 403 and seventh transistors 401 have source nodes commonly coupled to an external voltage Vext. A drain node of the seventh transistor 401 is commonly coupled to the drain node of the first transistor 407 of the adaptive bias current mirror circuit. In one embodiment of the invention, the voltage regulator circuit 400 further comprises an output transistor 404 having a source node coupled to an output resistive load circuit 413 and 414, a drain node coupled to the external voltage. The voltage regulator circuit 400 of the current embodiment also comprises a parasitic capacitance 411 coupled to common gate nodes of the fifth transistor 402, sixth transistor 403 and the output transistor 404 and a gate of the fourth transistor 406 coupled to the common output node of the load circuit. The high current at the tail node increases a start-up time, which follows from the equation I=C. dv/dt. Herein dt is seen as being inversely proportional to current. The current charging the capacitor on the node NGATE is a tail current Itail. Hence, increasing the current Itail brings down the start up time.

The high current at the adaptive bias current mirror circuit develops a voltage drop across source degenerate resistor limiting the gate-to-source voltage of the adaptive bias current mirror transistors and output peak current to thereby limit an output overshoot at the output node Vout. Output peak current will cause the regulator output voltage to overshoot which won't be tolerable in many designs. So the degenerate resistor restricts the vgs (gate to source voltage of the adaptive bias current mirror circuit) to reduce the peaking of current and hence overshoots on the output voltage.

Adjusting the adaptive biasing to regulate the start up time specification for lower external (Vext) voltages results in over-design, and the adaptive bias peak currents are so high that there are overshoots (peak currents) at output. According to an exemplary embodiment of the present invention, by adding a degenerate resistor 410 to the first and second adaptive biased current mirror transistors 407 and 408, respectively, the current overshoots at the output (Vout) are limited to a minimal value. As the excessive DC current from the positive feedback loop comprising of current mirrors and associated local transistors reaches the adaptive biased current mirror circuit, a voltage drop is created across the degenerate resistor 410 that limits the gate-source voltage (VGS) of the first and second current mirror transistors 407 and 408, which further limits the current, thereby limiting the peak currents at the output (Vout). Current overshoots are maintained close to a constant value across external supply voltage (Vext). The current overshoot can take up a value in range of 1 mA to 10 mA, which can be reduced to 100 s of uA using the voltage regulator 400 in a non limiting example of the invention.

Figure 5:
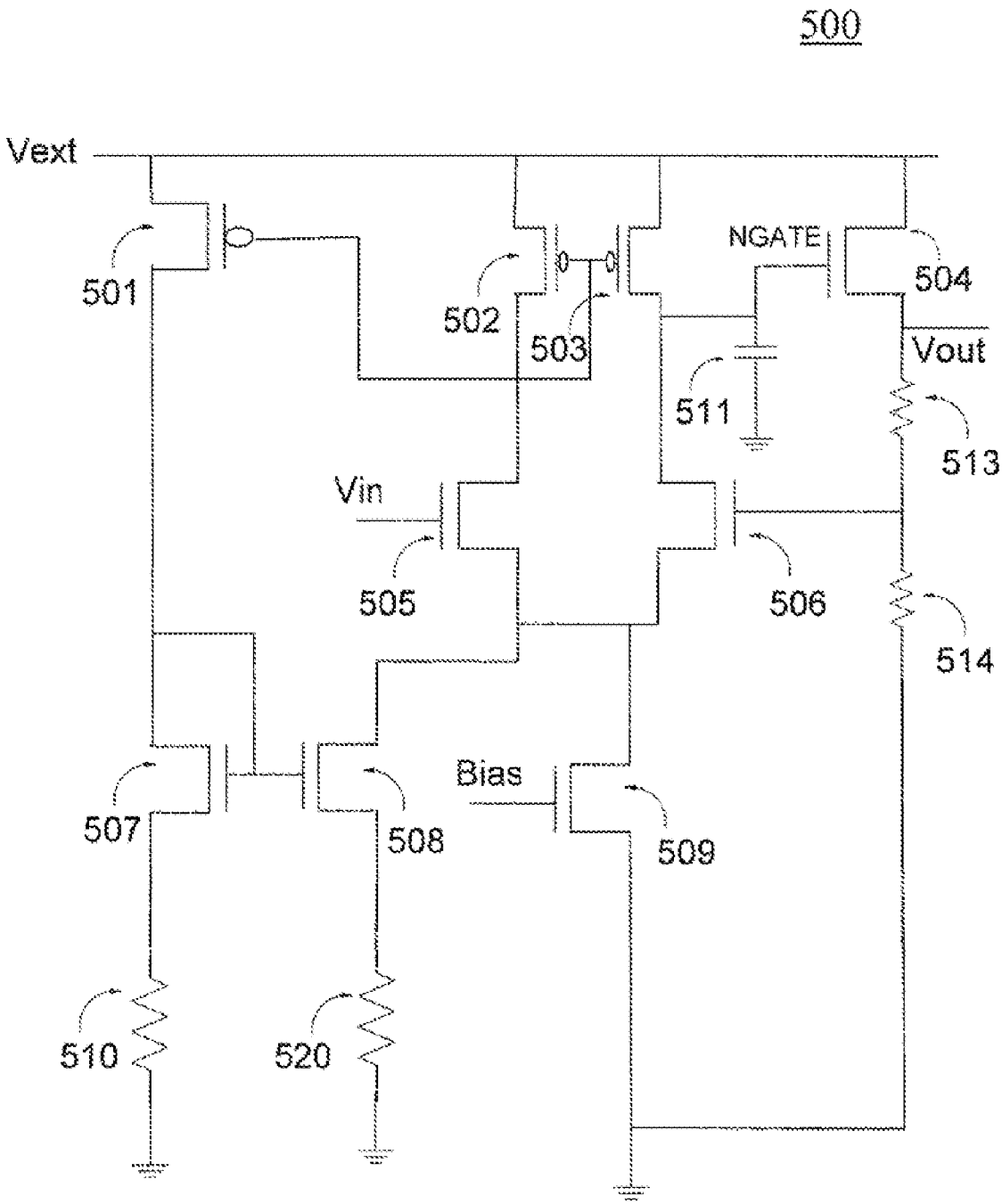
FIG. 5 illustrates an improved voltage regulator circuit in accordance with an exemplary embodiment of the invention.

According to one exemplary embodiment of the present invention, an improved voltage regulator circuit 500 as illustrated by FIG. 5 comprises an adaptive bias current mirror circuit further comprising a first transistor 507 and a second transistor 508 coupled together in an adaptive bias current mirror configuration. A first source degenerate resistor 510 is coupled to the first transistor 507 and a second source degenerate resistor 520 is coupled to the second transistor 508. The other terminals (other than ones connected to transistors 507 and 508) of both the first source degenerate resistor 510 and the second source degenerate resistor 520 are either grounded or otherwise coupled to a suitable reference voltage (having a lesser potential than input voltage Vin in an exemplary and non limiting embodiment of the present invention. Either of the first source degenerate resistor or second source degenerate resistor can be made equal to zero in an alternate embodiment of the present invention. In an example of the present invention, the adaptive bias circuitry is turned on until the voltage regulator gets enabled and slew. This is done for preventing the voltage regulator circuit from consuming excessive DC current.

Figure 6:
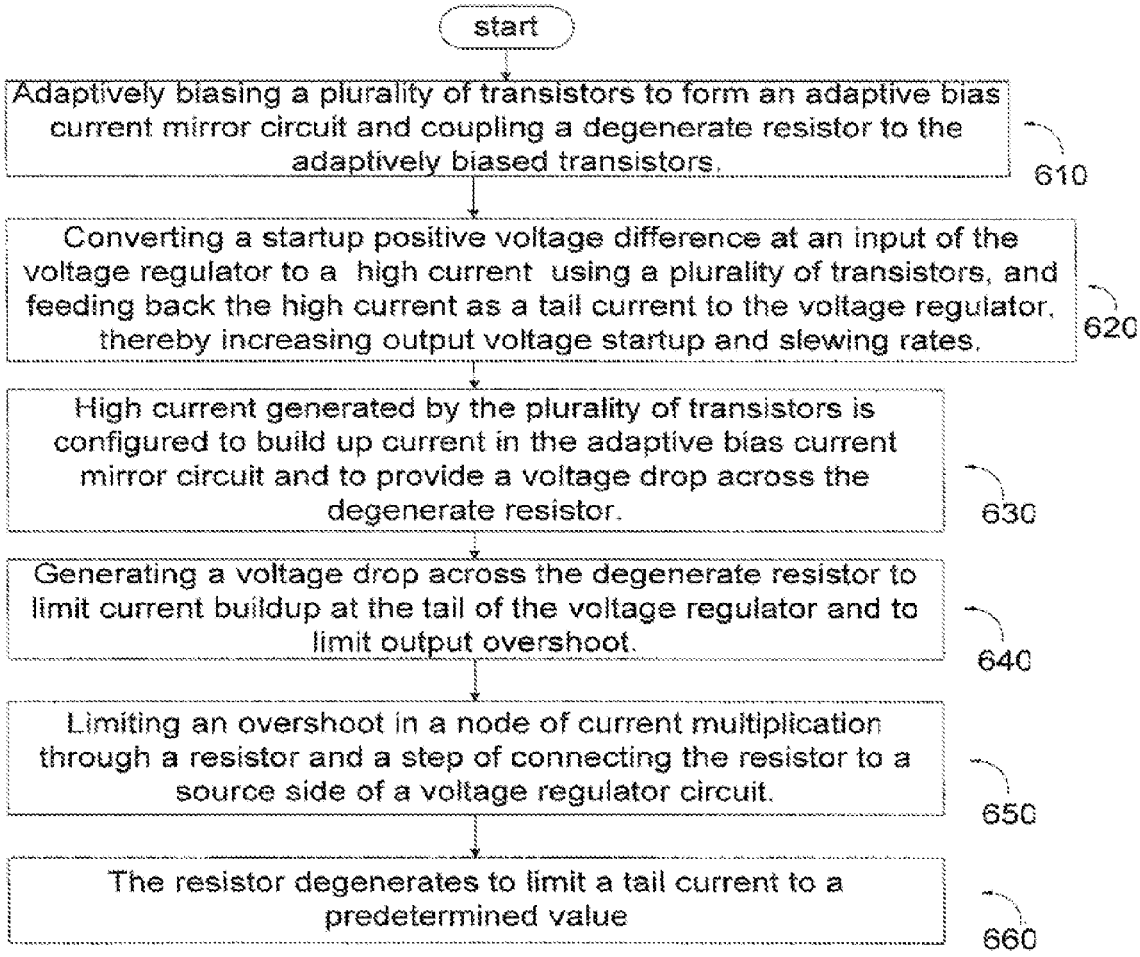
FIG. 6 illustrates a flow chart of a method to reduce overshoots in adaptively biased voltage regulator, in accordance with an exemplary embodiment of the present invention.

FIG. 6 is a flowchart illustrating a method 600 to reduce overshoots in adaptively biased voltage regulators in exemplary embodiment of the present invention. The method comprises a first step 610 of adaptively biasing a plurality of transistors to form an adaptive bias current mirror, and coupling a degenerate resistor to the adaptively biased transistors. The method of the current embodiment further comprises a step 620 of converting a startup positive voltage difference at an input of the voltage regulator to a high current using a plurality of transistors, and feeding back the high current as a tail current to the voltage regulator, thereby increasing output voltage startup and slewing rates. In a third step 630 the high current generated by the plurality of transistors is configured to build up current in the adaptive bias current mirror circuit and to provide a voltage drop across the degenerate resistor. The method of the current embodiment also comprises a step 640 of generating a voltage drop across the degenerate resistor to limit current buildup at the tail of the voltage regulator and to limit output overshoot, a step 650 of limiting an overshoot in a node of current multiplication through a resistor and a step of connecting the resistor to a source side of a voltage regulator circuit. The resistor degenerates to limit a tail current to a predetermined value in a step 660.

Figure 7:
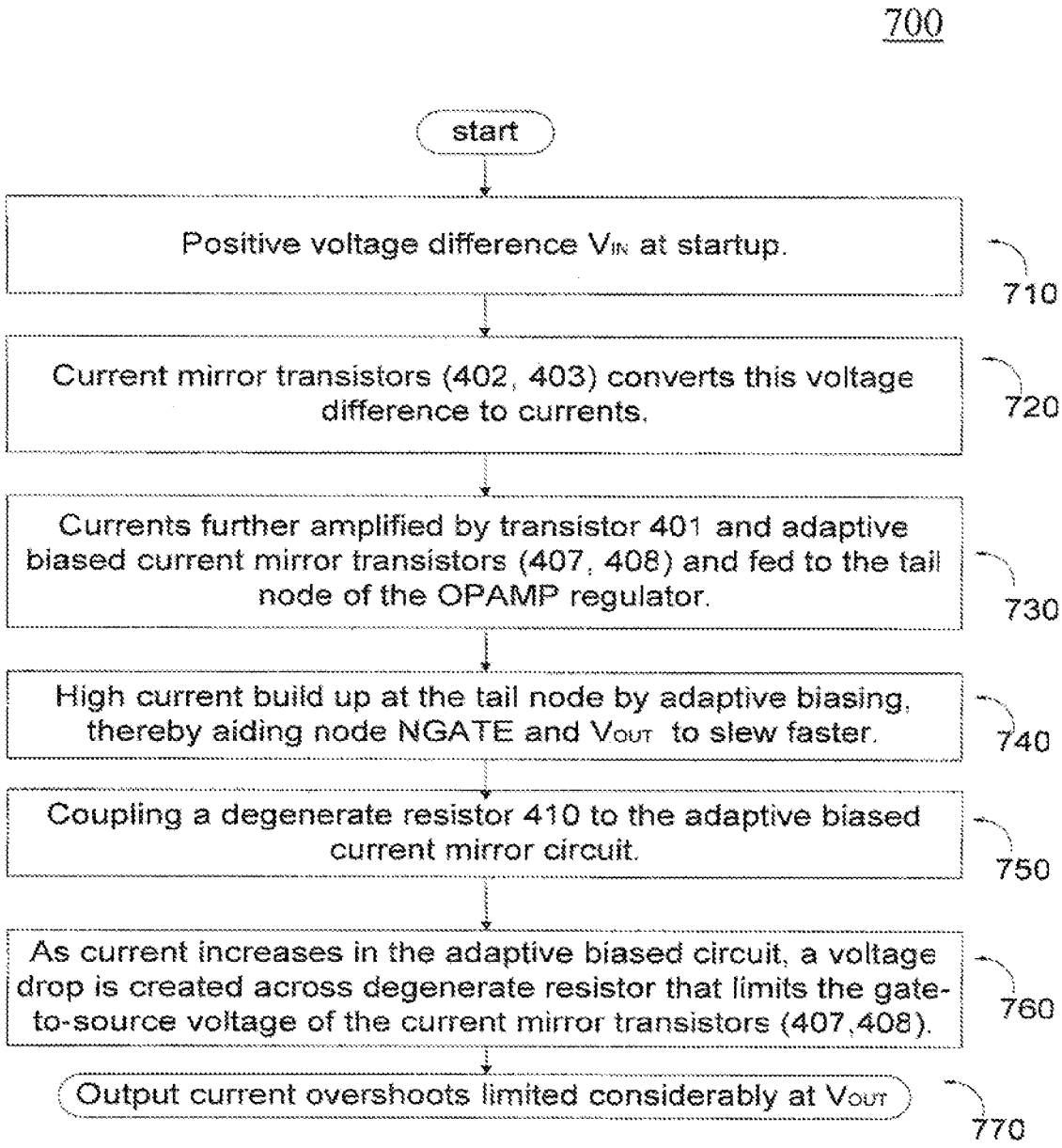
FIG. 7 illustrates a flow chart of a method to reduce overshoots in adaptively biased voltage regulator, in accordance with an alternate exemplary embodiment of the present invention.

FIG. 7 is a flowchart illustrating a method 700 to reduce output overshoots in an adaptively biased voltage regulator circuit in an exemplary and non limiting alternate embodiment of the present invention. The first step 710 comprises applying a positive voltage difference (Vin) at the input of the voltage regulator at startup. A next step 720 comprises converting the current of the positive input voltage difference created by the first and second current mirror transistors 402 and 403 respectively. A next step 730 comprises amplifying the current by transistor 401 and first and second adaptive biased current mirror transistors 407 and 408. The amplified current is finally led to the tail node of the voltage regulator circuit 400. A next step 740 comprises causing the high current build up at the tail node, thereby aiding the output voltage (VOUT) to slew faster. A next step 750 comprises coupling a degenerate resistor 410 to the adaptive biased current mirror circuit. A next step 760 comprises creating a voltage drop created across the degenerate resistor 410 due to the rise in current in the adaptively biased current mirror circuit. The voltage drop across degenerate resistor 410 further limits the gate-source voltage (VGS) of the first and second current mirror current mirror transistors 407 and 408. A next step 770 comprises, limiting of the output current overshoots considerably.

According to an exemplary embodiment of the present invention, an adaptively biased voltage regulation device 400 is disclosed, which comprises a gate connected current mirror circuit 402 and 403. A pair of input transistors 405 and 406 is coupled to the gate connected current mirror transistor circuit constituted by the transistors 402 and 403. An adaptive bias current mirror circuit is coupled to the pair of input transistors 405 and 406. A bias transistor 409 is coupled to the pair of input transistors 405 and 406. The gate connected current mirror circuit comprises a pair of current mirror transistors 402 and 302 having common gate connected to a mirror transistor 401 and connected to an output transistor 404. A voltage signal Vin is applied to an input terminal of a first input transistor 405 of the pair of input transistors. The adaptive bias current mirror circuit further comprises a source degeneration unit 410. Both the adaptive bias current mirror circuit and the bias circuit are coupled to a common node of the pair of input transistors. A parasitic capacitance 411 is coupled between the gate connected current mirror circuit and an output transistor.

According to an exemplary embodiment of the present invention, a circuit for reducing overshoot in an adaptively biased voltage regulator circuit comprises an adaptively biased current mirror circuit. The adaptively biased current mirror circuit comprises a first current mirror transistor coupled to a first source degenerate resistor. The adaptively biased current mirror circuit also comprises a second current mirror circuit coupled to a second source degenerate resistor. Either of first source degenerate resistor or second source degenerate resistor can be made equal to zero.

Advantages of the improved voltage regulator circuit of the present invention include meeting or otherwise maintaining the start up time specification of the voltage regulator while keeping the overshoots within tolerable limits. For large tail currents, minimal integrated circuit area is consumed. Further, the improved circuit is a minimal component complexity adaptively biased voltage regulator circuit.

Exemplary embodiments of the present invention can be used in conjunction with any suitable type of integrated circuit, such as a standby regulator circuit, to improve start up time of the voltage regulator, limiting a tail current and to control overshoots at the output of the voltage regulator.

Embodiments of the present invention are well suited to performing various other steps or variations of the steps recited herein, and in a sequence other than that depicted and/or described herein. In one embodiment, such a process can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. As used herein, a "computer-readable medium" can be any means that can contain, store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium. More specific examples (a non-exhaustive list) of the computer-readable medium can include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CDROM).

Details of the improved voltage regulator circuit and the methods of designing and manufacturing the same that are widely known and not relevant to the present discussion have been omitted from the present description for purposes of clarity and brevity.

It should be appreciated that reference throughout the present specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more exemplary embodiments of the present invention.

Similarly, it should be appreciated that in the foregoing discussion of exemplary embodiments of the invention, various features of the present invention are sometimes grouped together in a single embodiment, figure, or description thereof for the purpose of streamlining the disclosure to aid in the understanding of one or more of the various inventive aspects. Such a method of disclosure, however, is not to be interpreted as reflecting an intention that the claimed invention requires more features than are expressly recited in each claim. Rather, as the following claims reflect, inventive aspects lie in less than all features of a single foregoing disclosed embodiment.

It will be appreciated by those of ordinary skill in the art that the present invention can be embodied in various specific forms without departing from the spirit or essential characteristics thereof. The presently disclosed embodiments are considered in all respects to be illustrative and not restrictive. The scope of the invention is indicated by the appended claims, rather than the foregoing description, and all changes that come within the meaning and range of equivalence thereof are intended to be embraced.

What is claimed is:

1. A voltage regulator circuit, comprising:

an adaptive bias current mirror circuit comprising a first transistor and a second transistor, the first transistor and the second transistor having gate nodes coupled to a drain node of the first transistor; and a common node coupled to the source node of the first transistor and the source node of the second transistor, wherein a source degenerate resistor is coupled to the adaptive bias current mirror circuit and is coupled to the common node, and wherein the source degenerate resistor is configured to limit an output peak current of the voltage regulator circuit.

2. The voltage regulator circuit of claim 1, comprising:

a third transistor and a fourth transistor having source nodes commonly coupled to form a tail node, wherein the tail node is coupled to the drain node of the second transistor; and a bias transistor having a drain node coupled to the tail node and a source node coupled to a circuit ground.

3. The voltage regulator circuit of claim 2, further comprising:

a current mirror circuit comprising a fifth transistor and a sixth transistor having common gate nodes coupled to a gate node of a seventh transistor, wherein drain nodes of the fifth transistor and the sixth transistor are coupled with drain nodes of the third transistor and the fourth transistor, and wherein the fifth, sixth and seventh transistors have source nodes commonly coupled to an external voltage.

4. The voltage regulator circuit of claim 3, wherein a drain node of the seventh transistor is commonly coupled to the drain node of the first transistor of the adaptive bias current mirror circuit.

5. The voltage regulator circuit of claim 3, further comprising:

an output transistor having a source node coupled to an output resistive load circuit, wherein a drain node of the output transistor is coupled to the external voltage; and a parasitic capacitor coupled to the gate node of the output transistor and the drain nodes of the fourth transistor and sixth transistor, wherein a gate node of the fourth transistor is coupled to the common output node of the load circuit.

6. The voltage regulator circuit of claim 2, wherein a positive input voltage differential comprises an input signal at a gate node of the third transistor to provide a high current to the adaptive bias current mirror circuit and tail node.

7. The voltage regulator circuit of claim 6, wherein the high current at the adaptive bias current mirror circuit develops a voltage drop across the source degenerate resistor to limit a gate-to-source voltage of the first and second transistors and the output peak current.

8. A voltage regulator circuit, comprising:

an adaptive bias current mirror circuit comprising a first transistor and a second transistor, the first transistor and the second transistor having gate nodes coupled to a drain node of the first transistor;

a first source degenerate resistor coupled to the first transistor;

a second source degenerate resistor coupled to the second transistor, wherein the first and second source degenerate resistors are configured to limit an output peak current of the adaptive bias current mirror circuit to maintain a predetermined start-up time of the voltage regulator circuit a third transistor and a fourth transistor having source nodes commonly coupled to form a tail node, wherein the tail node is coupled to the drain node of the second transistor; and a bias transistor having a drain node coupled to the tail node and a source node coupled to a circuit ground.

9. A method for maintaining start-up time and reducing overshoots in a voltage regulator circuit, comprising:

adaptively biasing a plurality of transistors to form an adaptive bias current mirror circuit;

coupling at least one source degenerate resistor to the adaptive bias current mirror circuit to limit an output peak current of the voltage regulator circuit to maintain a predetermined start-up time of the voltage regulator circuit;

converting a startup positive voltage difference at an input of the voltage regulator circuit to a high current using a plurality of transistors; and feeding back the high current as a tail current to the voltage regulator circuit, thereby increasing output voltage startup and slewing rates.

10. The method of claim 9, wherein the high current generated by the plurality of transistors is configured to build up current in the adaptive bias current mirror circuit and to provide a voltage drop across the at least one source degenerate resistor.

11. The method of claim 9, wherein coupling at least one source degenerate resistor comprises generating a voltage drop across the at least one source degenerate resistor to limit current buildup at a tail of the voltage regulator and to limit output overshoot.

12. The method of claim 9, further comprising:

limiting an overshoot in a path of current multiplication through the at least one source degenerate resistor; and connecting the at least one source degenerate resistor to a source side of the voltage regulator circuit.

13. The method of claim 12, wherein the at least one source degenerate resistor degenerates to limit a tail current to a predetermined value.

14. A voltage regulation device, comprising:

a gate-connected current mirror circuit;

a pair of input transistors coupled to the gate-connected current mirror transistor circuit;

an adaptive bias current mirror circuit including a source degeneration unit coupled to the pair of input transistors, wherein the source degeneration unit is configured to limit an output peak current of the voltage regulation device to maintain a predetermined start-up time of the voltage regulation device; and a bias transistor coupled to the pair of input transistors, wherein both the adaptive bias current mirror circuit and the bias circuit are coupled to a common node of the pair of input transistors.

15. The device of claim 14, wherein the gate-connected current mirror circuit comprises:

a pair of current mirror transistors having common gates connected to a mirror transistor and connected to an output transistor.

16. The device of claim 14, wherein a voltage signal is coupled to an input terminal of a first input transistor of the pair of input transistors.

17. The device of claim 14, wherein the source degeneration unit comprises at least one source degeneration resistor.

18. The device of claim 14, wherein a parasitic capacitor is coupled between the gate-connected current mirror circuit and an output transistor.

* * * * *